US005923291A

United States Patent [19]

Page

[11] Patent Number: 5,923,291

[45] Date of Patent: Jul. 13, 1999

[54] OPTICALLY CONTROLLED ANTENNA, PROVIDING CONTINUOUS COVERAGE

[76] Inventor: Derrick J. Page, 1645 Severn Chapel Rd., Crownsville, Md. 21032

[21] Appl. No.: 09/017,099

[22] Filed: Feb. 2, 1998

[51] Int. Cl.[6] ..... H01Q 3/22

[52] U.S. Cl. ..... 342/375; 342/368

[58] Field of Search ..... 342/368, 372, 342/373, 374, 375

[56] References Cited

U.S. PATENT DOCUMENTS

| | | | |
|---|---|---|---|
| 4,814,773 | 3/1989 | Wechsberg et al. | 342/368 |
| 5,325,102 | 6/1994 | Page | 342/375 |
| 5,345,321 | 9/1994 | DeJule et al. | 359/42 |
| 5,367,305 | 11/1994 | Völker et al. | 342/368 |
| 5,400,038 | 3/1995 | Rita et al. | 342/375 |

*Primary Examiner*—Thomas Tarcza
*Assistant Examiner*—Dao L. Phan
*Attorney, Agent, or Firm*—H. C. Lin Patent Agent

[57] ABSTRACT

An array antenna is steered by moving a set of optical fibers of different optical length between a number of light signal sources and an array of antennas. By changing the lengths of the optical paths of the different light signals sources, the wave front can be steered. The light signal traverses three sections of optical delay lines with at least one selectable optical length. In the first section, light signal from a point source travels through a first optical delay line and a lens to diverge and collimate the light beam with increased cross section. The collimated light beam is focused by second lens and incident one second optical line of selectable optical length. The light beam exiting from the other end of the second optical line is collimated again by a third lens to face a third optical line. The collimated light exiting from the second optical line is focused again by a fourth lens to feed the third optical line, which is connected at the other end to one element of the antenna array. This defocused and focused arrangement allows the steering of the radiation pattern to be continuous and not intermittent. The second fiber optic lines are mounted on a rotatable disk with respect to the first and third optical lines which are terminated on a concentric stationary disk. The antenna array can serve both for a transmitter or a receiver, which can be a signal processor.

21 Claims, 8 Drawing Sheets

OPTICALLY CONTROLLED ANTENNA, PROVIDING CONTINUOUS COVERAGE

BACKGROUND OF THE INVENTION

1. Field of the Invention

This invention relates to array antennas and is particulary concerned with providing time delay steering to array antenna elements.

2. Description of the Prior Art

An array antenna consists of a group of antenna elements uniformly spaced apart to form an array. The array can be used for transmitting a beam of microwave energy in a chosen direction or receiving a microwave signal from a particular direction. This beam steering is achieved by controlling the relative timing or phasing of the individual elements.

The most common means of steering a beam in an antenna array is to control the relative phase of the signal at the elements. For the case of a flat antenna array, if all the elements are operated in unison, the beam will be pointed in the broadside direction, which is the direction perpendicular to the plane of the array. If a linearly increasing phase shift is introduced across the face of the array, the beam will be deflected at some angle from the broadside direction. Such antenna systems, referred to as phased arrays, are employed in applications where it is required to steer the beam rapidly in space and where the use of parabolic dish antennas is not practical.

Controlling the relative phase of each of the antenna elements requires that each element contain a phase shifting device and that an electronic control system be used to control the phase of each of the elements. However, the wide scale use of phased arrays has been limited by the high cost of their complex circuitry. Furthermore, if the phase shifting circuit is adjusted to steer in a particular direction, this setting will only be valid for a particular frequency. Adjacent frequencies will be transmitted or received with directional errors, a phenomena known as "squint". Therefore, known phase shifting techniques impose a limit on the frequency range of operation.

Another technique that is used to steer the beam in an array antenna is to control the relative timing of the transmitted or received signal at the array element. In the tansmission mode, if the signal at each of the elements is emitted in unison, a wavefront is formed that is parrallel to the plane of the array. The signal beam is directed perpendicular to the wavefront, therefore, when the signal is emitted from the antenna elements in unison, the beam is directed perpendicular to the plane of the array (the boresight direction). When the emission from the antenna elements is not in unison, but is varied in time along the array the angle of the wavefront relative to the plane of the array will change and the beam will be steered away from boresight. If, for example, the signal emission from any element relative to its nearest adjacent element is delayed a time t and each element is spaced a distance d apart, the steered angle $\phi$ between the boresight direction and the beam direction is given by the formula $\sin \phi = t\ c/d$, where c represents the velocity of electromagnetic propagation in space. True time delay techniques allow antenna arrays to operate over extremely wide frequency ranges as the delay techniques are frequency independent.

The use of fiberoptic communication systems is known A commercially available laser unit is used to convert a microwave signal to an amplitude modulated optical signal.

The optical signal travels through the optical fiber to where it is converted back to a microwave signal by an optical detector and a microwave amplifier, which are commercially available. Optical techniques have been suggested to control array elements. Schemes have been proposed to use a selection of optical fibers with lengths arranged in a binary or quadratic sequence and to switch in a series string combination to achieve a desired timing. This would result in a very complex control employing thousands of optical fibers and optical switches for even the simplest array.

A scheme using two sets of fiber, each having a parabolic distribution of lengths has been described in U.S. Pat. Nos. 5,325,102 and 5347,288. By aligning these two sets of fibers and moving one set relative to the other, a linear and variable set of delay paths can be generated which can be incorporated into an antenna array to provide the timing needed to form and steer the beam. This scheme is difficult and costly to fabricate as it is necessary to align a large set of fiber optics end to end with a second set and to be able to reposition and realign each time the beam steering is adjusted.

A further drawback of the optical commutator approach to beam steering is that the signal is interrupted during the repositioning of the transmitted and received beams. This means the approach cannot be used for communications applications that require continuous and uninterrupted service.

SUMMARY OF THE INVENTION

An object of this invention is to provide a device that performs the steering and timing function for an antenna array. Another object of this invention is to provide continuous coverage during the beam steering operation.

These objects are achieved by using a timing scheme for a particular array antenna design which is 'hard wired' by having a set of optical fiber delay lines built into a movable element. The optical fiber delay lines of the movable element are of selected lengths and each have first ends fitted with a lens which is alignable to a set of optical sources. A second end of each of the movable fibers is also fitted with a lens and is alignable to a second set of optical fibers. The second set of optical fibers is connected to one or more optical detectors. I refer to the movable set of optical fibers and the associated mechanism and components as an "optical commutator".

The function of the lenses connected to the ends of the fibers is twofold. Firstly, the lenses greatly reduce the mechanical tolerances required to align the sets of fibers within the commutator. Secondly, the lenses allow light to be shared with neighboring fibers so that continuous coverage can be obtained as the beam is steered. This is in contrast to my earlier design disclosed in U.S. Pat. Nos. 5,325,102 and 5,347,288 that necessitated the interruption of the signal during the adjustment from one alignment position to the next.

In a first preferred embodiment, the hard-wired optical delay lines are built onto a rotatable rotor disk. The first end of each of the fibers terminates on a lens that in turn terminates on one face of the disk and the second end terminates on a lens which also terminates on the same face, but at a different radius from the first.

A stator is provided. The stator is a second stationary disk having an axis common with the rotor disk. The stator disk is fitted with a first set of lenses evenly spaced around a particular radius. These lenses focus the light upon the ends of a set of stationary optical fibers having selected lengths and connected to amplitude modulated light sources. The stator disk is also fitted with a second set of lenses evenly spaced around a different radius from that of the first set of lenses. Each lens of the second set focuses the light from the rotor set of fibers onto the ends of a second set of optical fibers that are connected to a set of optical detectors.

The positioning of the lenses on the rotor and stator disks are such that light may pass from the light source via an optical fiber to the first end of each of the rotor fibers and then out of each of the second end of the rotor fibers into the second set of stator fibers and then to the detectors.

The lenses on the rotor and stator are such that when the rotor and stator lenses are in alignment as a result of turning the rotor, the light will pass from one fiber to the next. When the rotor is turned to an intermediate position, the light from adjacent rotor fibers will be blended to form a signal having a timing that is intermediate between that which occurs when the lenses are in complete alignment and when they are turned to the next complete alignment position.

The rotor is preferably fitted with a servomotor.

When the optical commutator is used to steer an antenna array, each element of the antenna array is provided with a signal delay path composed of two optical delay lines in series and precise timing can be achieved to form the antenna beam. By turning the rotor, the direction of the antenna beam may be continuously steered in space.

The optical commutator may be employed in a transmitting antenna or a receiving antenna or both.

The antenna elements may be arranged in a linear array, or placed on an arc of a circle.

Other objects and advantages of the invention will become apparent from the description of certain present preferred embodiments thereof shown in the drawings.

DETAILED DESCRIPTION OF THE PREFERRED EMBODIMENT

Figure 1:
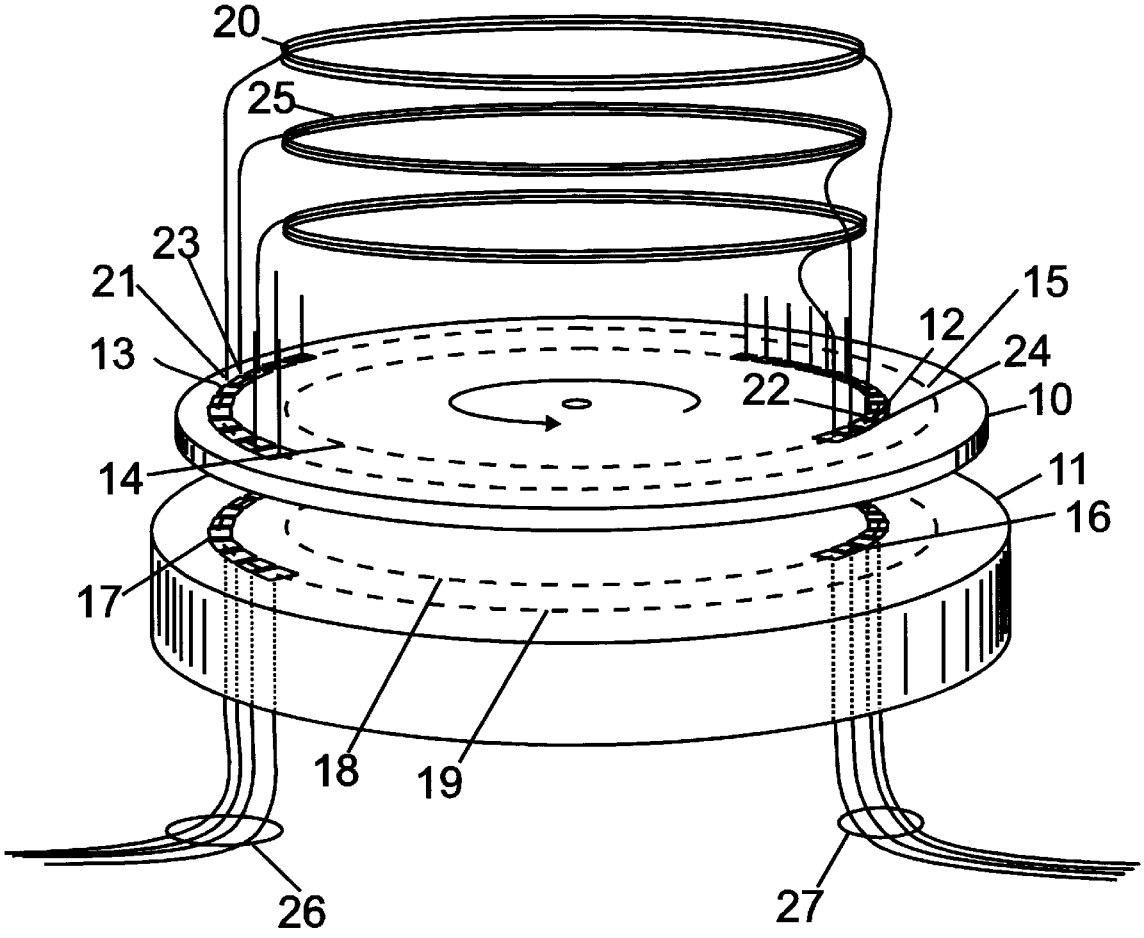
FIG. 1 is an exploded perspective of a preferred optical commutator.

Referring to FIG. 1 which shows an exploded view of a preferred embodiment of the optical commutator. A rotatable rotor 10 shares a common axis with a stationary member 11 referred to as the stator. Mounted on the rotor are two sets of lenses 12 and 13 arranged around circles 14 and 15 respectively. The stator is fitted with two similar sets of lenses 16 and 17 that are arranged on circles 18 and 19 respectively. The diameters of circles 15 and 19 are identical. The diameters of circles 14 and 18 are identical. Mounted on the rotor is optical fiber 20 whose first end 21 is located at the focal point of lens 13 and whose second end 22 is located at the focal point of lens 12. Lens 23 is located clockwise adjacent to lens 21 and is connected by optical fiber 25 to lens 24 which is clockwise adjacent to lens 22. In a similar fashion other optical fibers are attached to the rotor and have their first and second ends located at the focal points of the other lenses arranged on the circles 15 and 14. Each lens on the circle is connected to another lens on circle 14. The lens-optical fiber-lens combinations are arranged to be in a clockwise sequence around the circles.

The angular pitch between all the lenses is the same.

An input set of optical fibers 26 is connected to the focal points of lenses located on circle 19 and a set of output optical fibers is connected to the focal points of lenses located on circle 18. The lengths of the input fiber set, the rotor fiber set and the output fiber set have a specific distribution that depends on the type and size of the antenna array that is being steered by the commutator.

Figure 2:
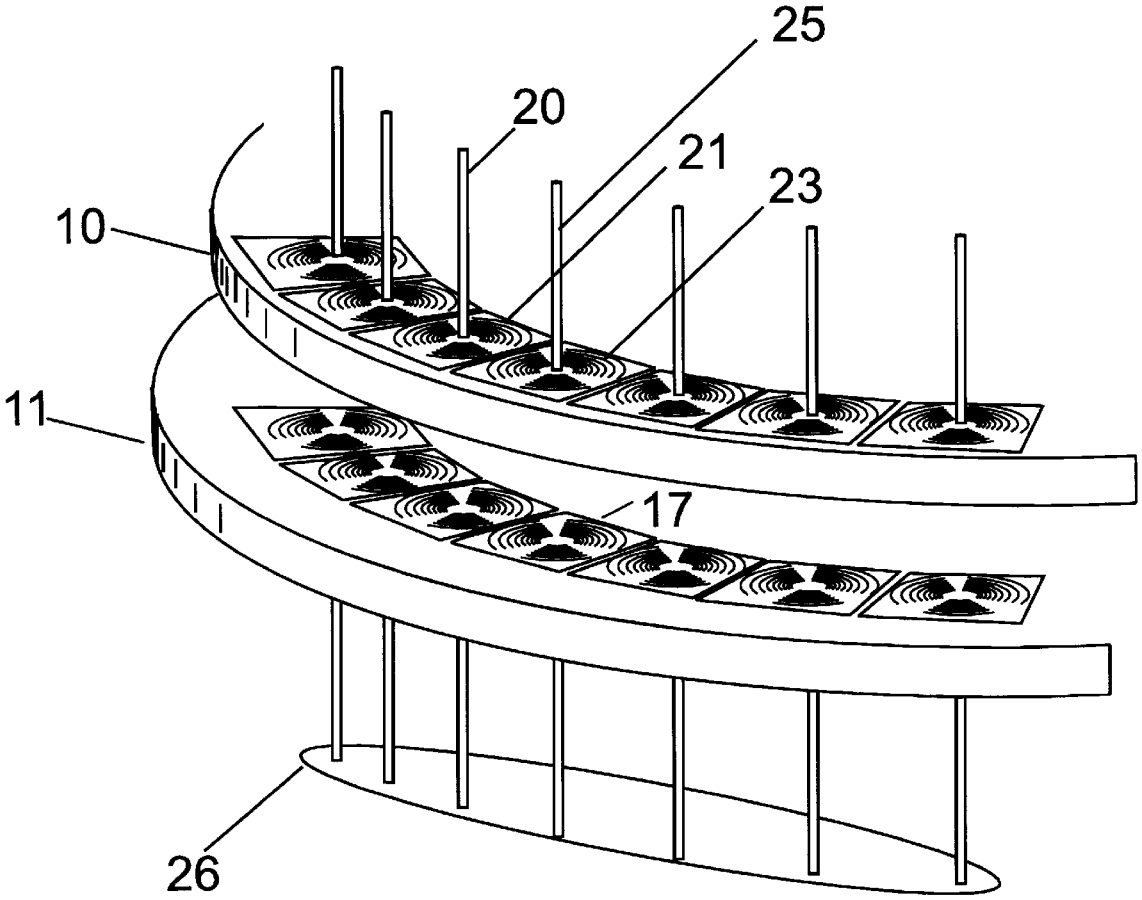
FIG. 2 shows some of the lenses on the stator and rotor of the optical commutator.

FIG. 2 shows a close up of a portion of the rotor 10 and the stator 11. The lenses such as 21 and 23 focus the light into optical fibers 20 and 25.

Figure 3:
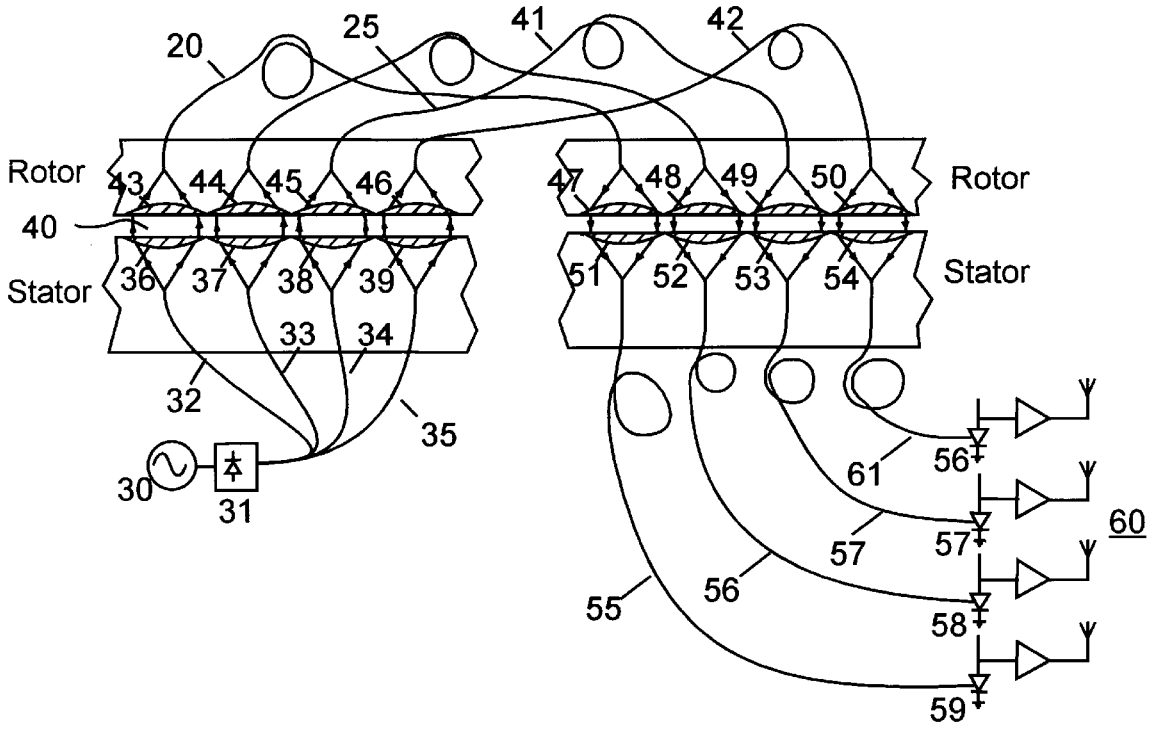
FIG. 3 is a schematic cross-sectional representation of the optical commutator when the lenses are in the full alignment position.

FIG. 3 shows a diagrammatic cross-section of the optical commutator used for a transmitter. A frequency source 30, having the frequency that is to be transmitted, is connected to a modulatable light source such as a laser diode 31. The light from the laser diode is passed through the fiber group 32, 33, 34 and 35. The light emerges from the optical fibers and is collimated by stator lenses 36, 37, 38 and 39. The light is caused to be in a parallel beam as it transgresses the gap 40 between the rotor and the stator. The light then is focused onto the ends of the rotor fibers by lenses 43, 44, 45 and 46. After passing through the rotor fibers 20, 25, 41 and 42, the light is once again condensed by lenses 47, 48, 49 and 50 to produce parallel beams across the rotor to stator gap. Finally the light is focused by lenses 51, 52, 53 and 54 onto the ends of the output fibers 55, 56,57 and 61. The light then passes onto detectors 56, 57, 58 and 59. The detectors convert the amplitude modulated light signal back into a radio frequency signal which is amplified and fed to the radiating elements of the antenna array 60. Note that in FIG. 3 the lenses of the stator and rotor are in the full alignment position.

Figure 4:
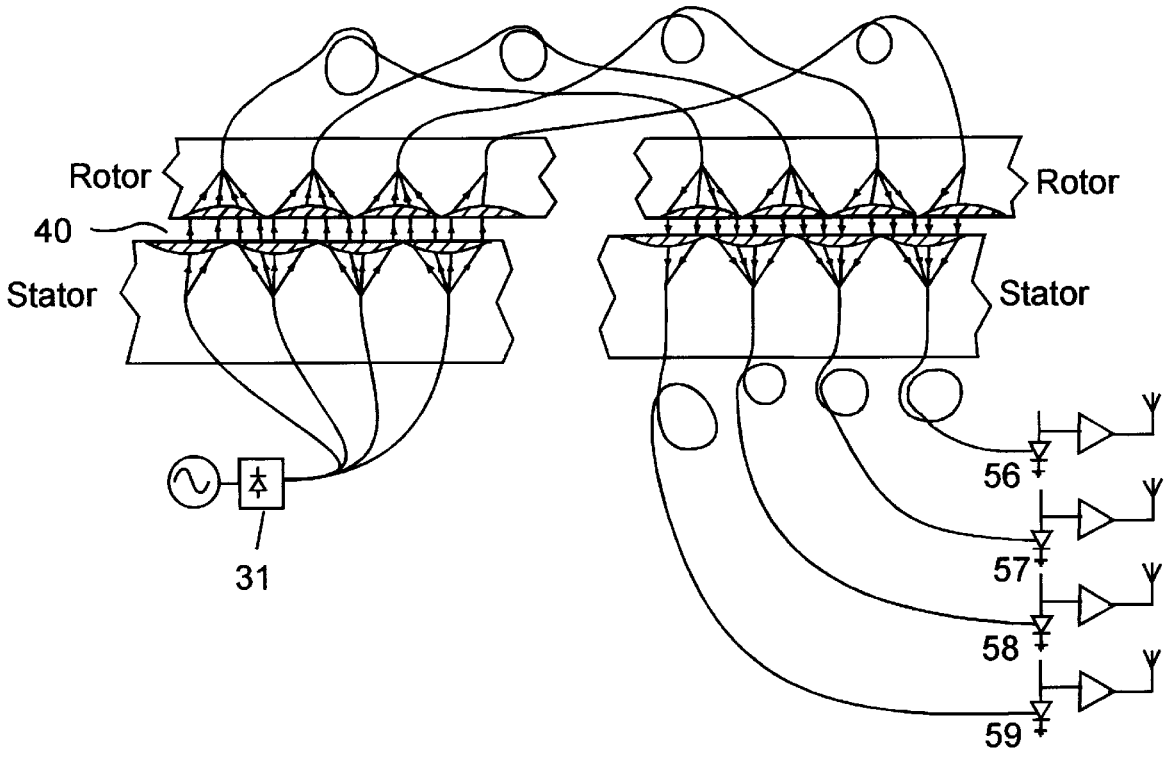
FIG. 4 is a schematic cross-sectional representation of the optical commutator when the lenses are not aligned.

FIG. 4 is similar to FIG. 3, but the rotor has been moved so that the lenses are no longer in alignment. However, as the light passing across the gap 40 is parallel, it is still being focused onto the fiber ends and the light is passed from the light source 31 to the detectors 56, 57, 58 and 59.

The lengths of the various optical paths between the source and the detectors is very important as they govern the relative time of arrival of the microwave signal at the antenna elements. This in turn will govern the direction the antenna array will radiate the microwave beam.

Figure 5A:
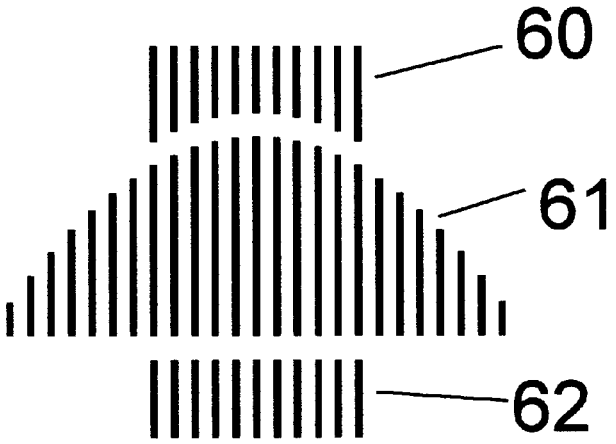
FIG. 5A shows a histogram depicting the stator and rotor optical fiber lengths for a linear array set in the boresight position.

To explain the operation of the antenna steering principle, FIG. 5A shows the shows the lengths of the stator input fibers 62, the rotor fibers 61 and the stator output fibers 60. The input fibers are all of the same length. The rotor fibers have a parabolic distribution and the output fibers also have a parabolic distribution and is the inverse of the parabolic distribution of the rotor distribution. The fibers are lined up in the boresight position so that the propagation time for the light will be the same for all the parallel paths. Alternatively, a cosine distribution may also be used.

Figure 5B:
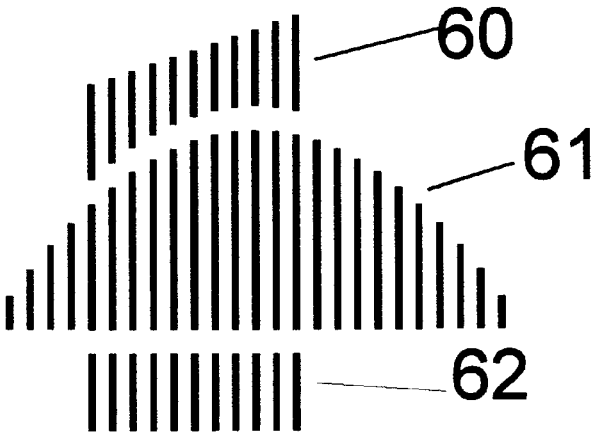
FIG. 5B shows a histogram depicting the stator and rotor optical fiber lengths for a linear array set in the steer to the right position.

FIG. 5B shows the same sets of fibers as FIG. 5A, but the rotor has been moved so that a different portion of the rotor fiber distribution is being used. Notice that due to the parabolic length distribution of sets 60 and 61, the total summed lengths of 60, 61 and 62 vary linearly. The time delays now vary linearly across the distribution.

Figure 5C:
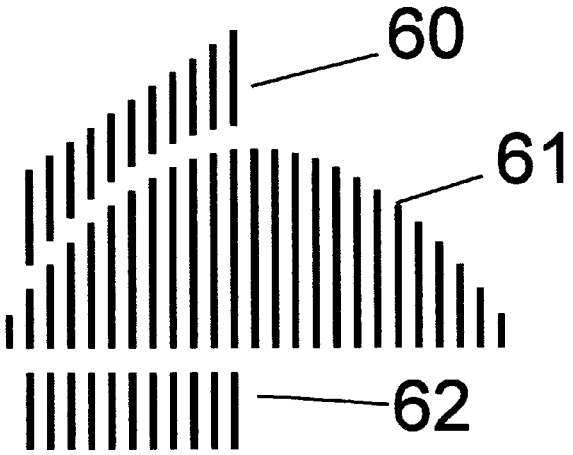
FIG. 5C shows a histogram depicting the stator and rotor optical fiber lengths for a linear array set in the steer to the far right position.

FIG. 5C shows the same sets of fibers, but with the rotor set moved even further than FIG. 5B. Here the linear distribution in the total fiber lengths has a wider spread. This linear variation in delay time introduced by the three sets of optical delay lines is the same as that required to steer a linear array antenna. The more the rotor fiber set is moved from the center boresight position, the more the array antenna will steer away from the boresight.

Figure 5D:
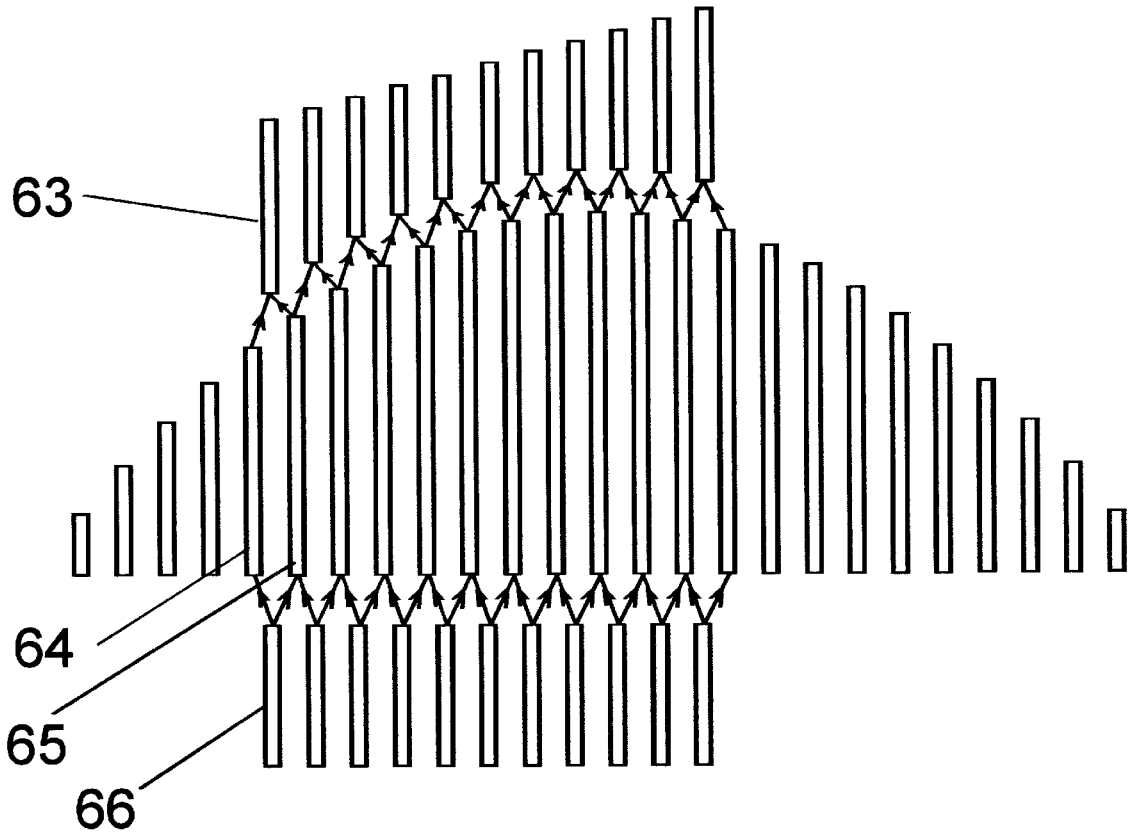
FIG. 5D illustrates the coupling of light from the input stator optical fibers to he rotor fibers and then to the output stator fibers.

During the time the movement of the rotor set of fibers occurs, the fibers will normally be misaligned and light may not pass from the input to the output of the commutator. This would cause a disruption of service. By blending light from adjacent fibers during the rotor repositioning continuous service can be accomplished. This is best explained by the illustration of FIG. 5D. This shows again the three sets of fibers, but when lenses are fitted to the ends of the fibers, light can pass from one fiber into the two opposite fibers. Consider amplitude modulated light of angular frequency co propagating in fiber 66. Upon emerging, the light is guided into rotor fibers 64 and 65. From 64 and 65 a portion of the light passes to fiber 63. If the fiber 64 introduces time delay $t_1$ and fiber 65 introduces time delay $t_2$ then the signal in fiber 63 will be the vector sum of A sin $\omega(t+t_1)$ and B sin $\omega(t+t_2)$ where A and B represent the relative amounts of light passing through fibers 64 and 65. As the rotor is turned between the position where rotor fiber 64 is in alignment with stator fiber 63 and the next full alignment position where 65 is in alignment with 63 the signal will change smoothly from having a delay of $t_1$ to having a delay of $t_2$. Any position between these two full alignment positions will result in an intermediate time delay between $t_1$ and $t_2$. In this manner the antenna pointing angle can be continuously varied.

Figure 6A:
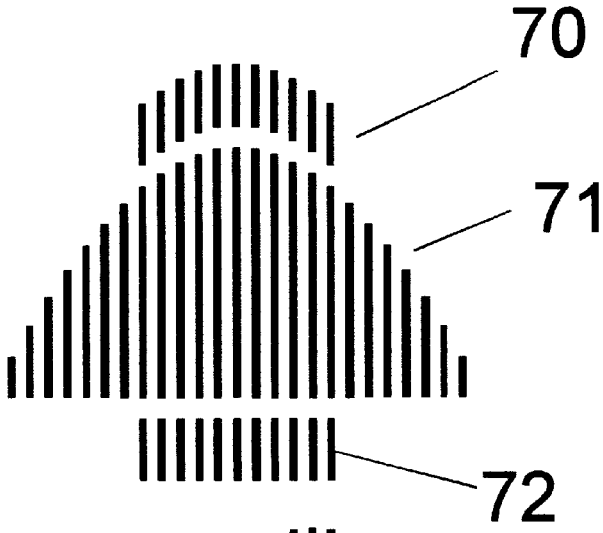
FIG. 6A shows a histogram depicting the stator and rotor optical fiber lengths for a curved antenna array set in the boresight position.
Figure 6B:
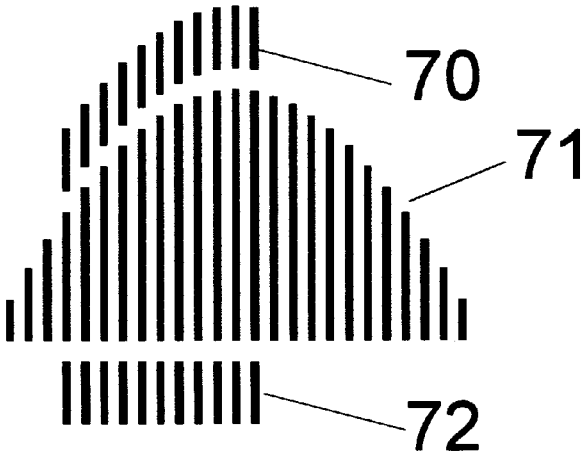
FIG. 6B shows a histogram depicting the stator and rotor optical fiber lengths for a curved antenna array set in the steer right position.
Figure 6C:
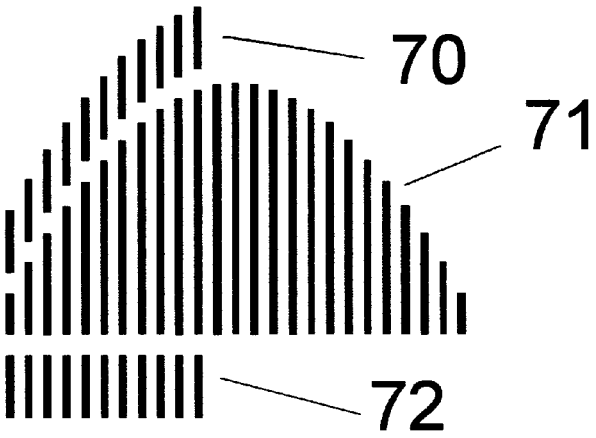
FIG. 6C shows the use of the histogram depicting the stator and rotor optical filter lengths for a curved antenna array set in the steer far right position.

In contrast to FIG. 5 which shows the lengths of optical fibers requires to steer an array of evenly spaced antenna element arranged on a plane, FIG. 6A shows the lengths required in steer an antenna where the elements are arrange on an arc of a circle. Here the rotor set of fibers 71 have a sinusoidal distribution and the input fibers 72 have a common length. The output fibers 70 have a common length. FIG. 6A shows the fibers lined up to form a beam in the boresight position. FIGS. 6B and 6C show the alignment for steering at an angle from boresight and steering at a larger angle from boresight. Again by placing lenses at the ends of the fiber, the light from adjacent fibers may be blended to give continuous and uninterrupted service from a curved antenna array.

Figure 7:
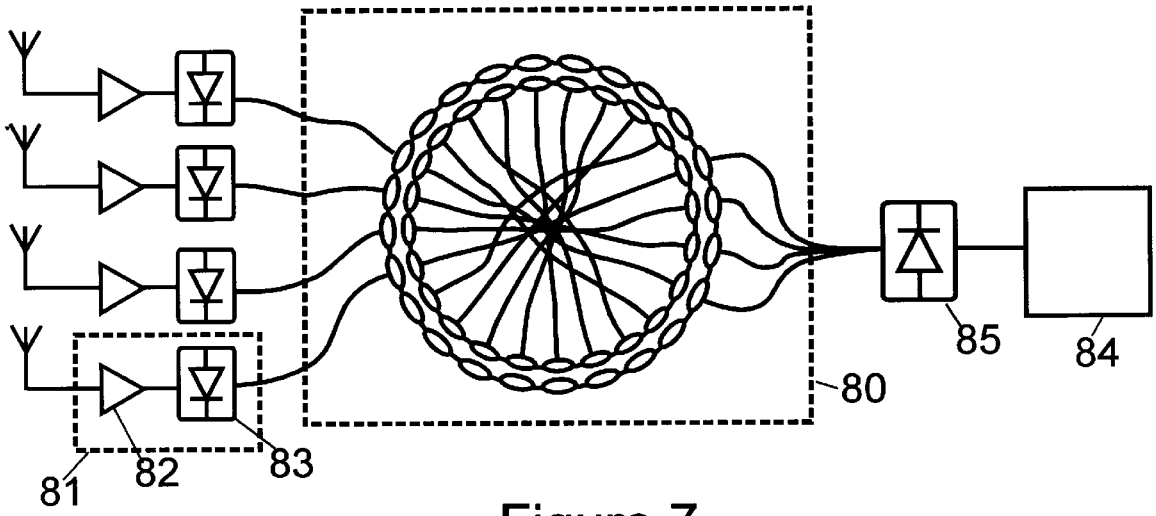
FIG. 7 shows the use of the commutator in a receiving system.

While the foregoing embodiment is described for the commutation of two circular disks, the concept is not limited to relative circular motion. For instance, commutation can be achieved with linear relative motion. While the description is devoted to steering a transmitting antenna array, the concept applies equally well to a receiving antenna since the optical system is bidirectional. For a transmitting antenna, the connection has been shown in FIG. 3. As a receiving antenna, a section 81 of an amplifier 82 and a laser light source 83 may be inserted between the commutator 80 depicted in FIG. 1 and each array element as shown in FIG. 7. The output from the commutator 80 is fed to an optical detector 85 and a receiver 84.

While certain present preferred embodiments have been shown and described, it is distinctly understood that the invention is not limited thereto but may be otherwise embodied within the scope of the following claims.

What is claimed is:

1. A device for delaying signals coupled to elements of an array antenna, the device providing delay paths of selectable length between the respective elements and an electronic unit, the device comprising:

a set of first optical lines, each first fiber optic line having a first end, a second wherein selected first fiber optic line first end is coupled to said electronic unit and said second end is fitted with a lens for collimating signals form said first end to become first collimated signals;

a set of second fiber optic lines, each second fiber optic line having a first end, a second end and a selected length and wherein each first end of selected second fiber optic lines is fitted a first focusing lens focusing the first collimated signals to become first focused signals from the second end of one of said selected first fiber optic lines and wherein the second fiber optic line second ends are fitted with a second collimated lens to collimated said first focused signals to become second collimated signals;

a set of third fiber optic lines, each third optic line having a first end and a second end wherein the first end of selected third fiber optic lines is fitted with second focusing lens and wherein third fiber optic line second ends are connected to respective said elements through optical to microwave converting means; and means for physically moving the set of second optical fibers with respect to the set of first fiber optic lines and the set of third optic lines, wherein each one of said delay paths comprises a series connection of one of said first optical lines, one of said second optic lines, and one of said third optic lines, and the output to said converting means is the vector sum of the signal components in adjacent parallel fibers in each said set of first fiber optic lines, said set of second fiber optic lines and said set of third optic lines.

2. A device for delaying signals as described in claim 1, wherein said means for moving rotates concentrically said second sets of optical fibers with respect to said first end of optical fibers and said third set of optic lines.

3. A device for delaying signals as described in claim 2, wherein each said second end of one of first fiber optic lines lies at the rim of a first circular disk; each said first end of each of second optic lines lies at the rim of a second circular disk; each said second end of said second optic lines lies at the rim of said second circular disk along an arc other than the said first end of said second optic lines.

4. A device for delaying signals as described in claim 3, wherein said first disk is stationary and said second disk is rotatable.

5. A device for delaying signals as described in claim 3, wherein said first disk is rotatable and said second disk is stationary.

6. A device for delaying signals as described in claim 1, wherein each said first collimating lens need not align with said first focusing lens and second collimating lens need not align with second focusing lens during operation to allow continuous transition of direction of steering of said array antenna.

7. A device for delaying signals as described in claim 6, wherein said first focusing lens may be incident with collimated light from adjacent two of said first collimating lens, and said second focusing lens may be incident with collimated light from adjacent two of said second collimated lens.

8. A device for delaying signals as described in claim 2, wherein the optical lengths of successive fiber lines of said second optic lines are not uniform along the rim of said second disk.

9. A device for delaying signals as described in claim 8, wherein said optical lengths describe a parabolic distribution along the rim of said second disk.

10. A device for delaying signals as described in claim 8, wherein said optical lengths describe a cosine distribution along the rim of said second disk.

11. A device for delaying signals as described in claim 2, wherein the optical lengths of said third optic lines are uniform along the rim of said first disk.

12. A device for delaying signals as described in claim 11, wherein the optical lengths of said first optic lines are uniform.

13. A device for delaying signals as described in claim 11, wherein the optical lengths of said optic lines are not uniform.

14. A device for delaying signals as described in claim 1, wherein the total optical length of an optical path through one of said first optic lines, one of said second optic lines and one of said third optic lines is uniform when said antenna is irradiating in a direction perpendicular to the plane of the array.

15. A device for delaying signals as described in claim 1, wherein said electronic unit is a transmitter.

16. A device for delaying signals as described in claim 15, further comprising a second electronic unit having a detector and an amplifier connected between each said second end of said set of third fiber optic lines to respective one of said antenna elements.

17. A device for delaying signals as described in claim 1, wherein said electronic unit is receiver.

18. A device for delaying signals as described in claim 17, wherein said receiver is a signal processor.

19. A device for delaying signals as described in claim 17, further comprising a second electronic unit having an amplifier and a laser diode connected between each said end of said set of third fiber optic lines to a respective one of said antenna elements.

20. A method of selectively delaying signals from a signal generating means to respective antenna elements, comprising the steps of:

providing a set of first optical fibers, each first fiber having a selected length and having a first end and a second end, wherein the first of a selected number of first fibers receiving signals from the signal generating means and the second ends of first fibers fitted each with a collimating lens, providing a set of second optical fibers, each second optical fiber having a selected length and having a first end and a second end, wherein the first ends of a selected number of second fibers are selectively facing and receiving optical signals from at least one of second ends of the first fibers, and wherein each one of said ends of second fibers are fitted each with a focusing lens, providing a set of third optical fibers, each one of said third optical fibers having a first end and a second end, wherein said first end of third optical fibers is located at a focal distance of said focusing lens and said second end of the third fibers is connected to a respective antenna element, and moving physically said set of second optical fibers with respect to said set of first optical fibers and said set of third optical fibers, so that said signal from said signal generating means is delayed by a series connection of one of said first optical lines, one of said second optic lines and one said third optic lines, and the signal arriving at each said antenna element is a vector sum of signal components in adjacent parallel fibers in said set of first optical fibers, said set of second optical fibers and said set of third optical fibers.

21. A device for delaying signals as described in claim 1, wherein said signals are not limited to polarized light.

* * * * *